US010739113B1

(12) United States Patent
Bosen et al.

(10) Patent No.: US 10,739,113 B1
(45) Date of Patent: Aug. 11, 2020

(54) RAPID DEPLOYMENT ANTI-BALLISTIC SHELTER

(71) Applicant: Armorworks Holdings, Inc., Chandler, AZ (US)

(72) Inventors: David A. Bosen, Tempe, AZ (US); Valent Horvatich, Scottsdale, AZ (US)

(73) Assignee: Armorworks Holdings, Inc., Chandler, AZ (US)

( * ) Notice: Subject to any disclaimer, the term of this patent is extended or adjusted under 35 U.S.C. 154(b) by 0 days.

(21) Appl. No.: 16/103,584

(22) Filed: Aug. 14, 2018

(51) Int. Cl.
*F41H 11/00* (2006.01)
*F41H 5/24* (2006.01)

(52) U.S. Cl.
CPC ..... *F41H 11/00* (2013.01); *F41H 5/24* (2013.01)

(58) Field of Classification Search
CPC ..... F41H 11/00; F41H 5/24
USPC ..... 89/36.02
See application file for complete search history.

(56) References Cited

U.S. PATENT DOCUMENTS 4,836,079 A * 6/1989 Barrett ..... B22C 3/00 86/50
6,595,102 B2 * 7/2003 Stevens ..... F41H 5/007 280/735
6,666,124 B2 * 12/2003 Fleming ..... B63B 3/10 89/36.12
6,857,460 B1 * 2/2005 Mowry ..... F41H 5/06 160/351
7,213,494 B2 * 5/2007 James ..... E04H 9/04 86/50
7,963,075 B2 * 6/2011 Howland ..... A62C 2/10 52/202
8,549,979 B2 * 10/2013 Spransy ..... F41H 5/013 89/36.07
8,752,336 B1 * 6/2014 Ozsuer ..... E04B 1/165 52/2.15
8,978,318 B2 * 3/2015 Klein ..... F41H 5/24 52/69
2007/0113486 A1 * 5/2007 Howland ..... A62C 3/02 52/1
2008/0257137 A1 * 10/2008 James ..... F42D 5/045 86/50
2009/0114084 A1 * 5/2009 Thinn ..... F41H 5/007 89/36.02
2012/0174763 A1 * 7/2012 Ritchie ..... E04H 9/10 89/36.04
2012/0174768 A1 * 7/2012 Spransy ..... F41H 5/013 89/36.09
2012/0248837 A1 * 10/2012 Peters ..... A47C 3/04 297/239
2015/0198424 A1 * 7/2015 Whitney ..... F41H 1/02 89/36.02

(Continued)

*Primary Examiner* — Samir Abdosh
(74) *Attorney, Agent, or Firm* — James L. Farmer

(57) ABSTRACT

Methods and apparatus are provided for a ballistic resistant shelter configured for emergency deployment in an open space. The shelter has a structural frame configured to rapidly convert from a stowed condition disposed substantially flat on the ground, to a deployed condition in which the frame is elevated substantially above ground level. One or more anti-ballistic panels are attached to the frame so as to be tilted or lifted above ground level when the frame is deployed. The anti-ballistic panels collectively present enough surface area to shield at least one person from a single source of gunfire.

16 Claims, 4 Drawing Sheets

(56) References Cited

U.S. PATENT DOCUMENTS

2018/0313074 A1* 11/2018 Brown ..... E04B 1/3444
2020/0018572 A1* 1/2020 Gonzales ..... F41H 5/08

* cited by examiner

FIG. 1
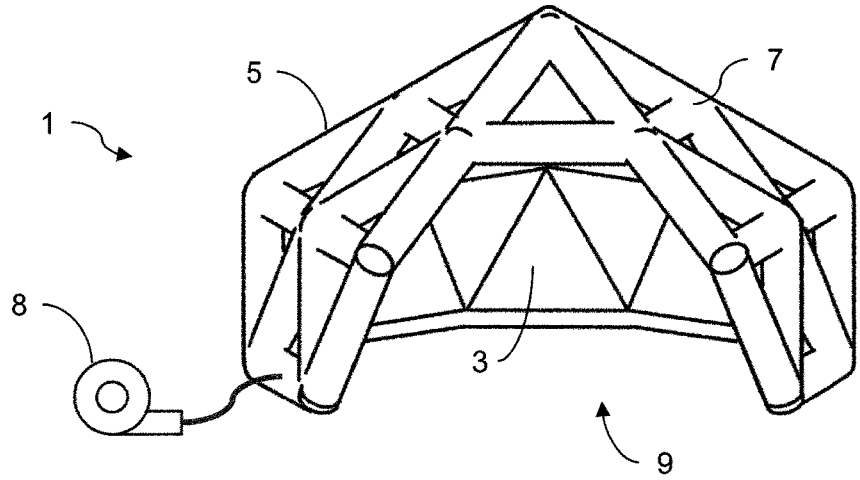
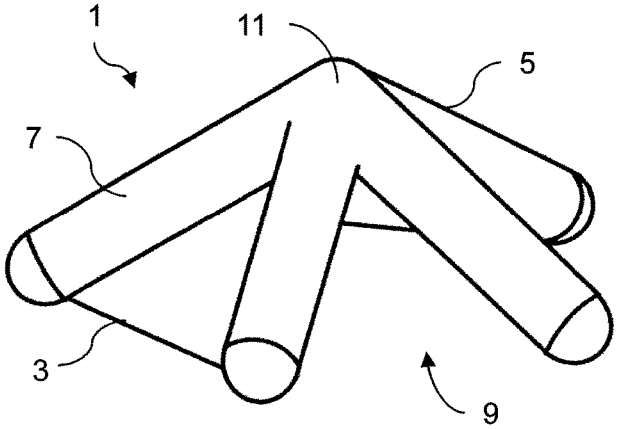
FIG. 2
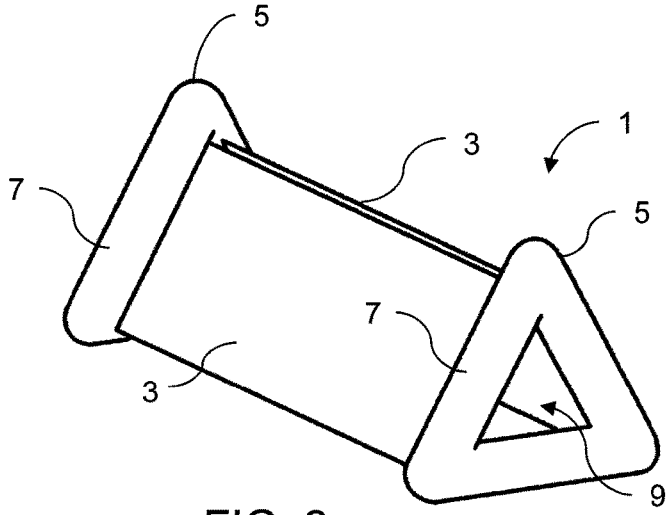
FIG. 3

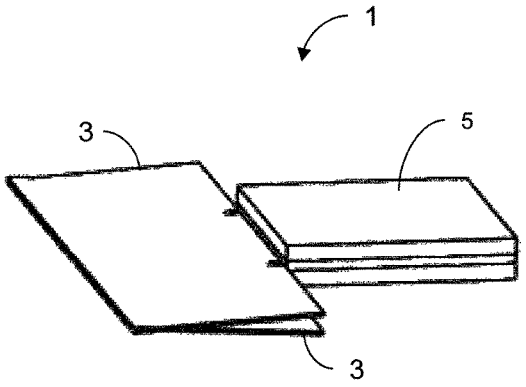
FIG. 7
FIG. 8
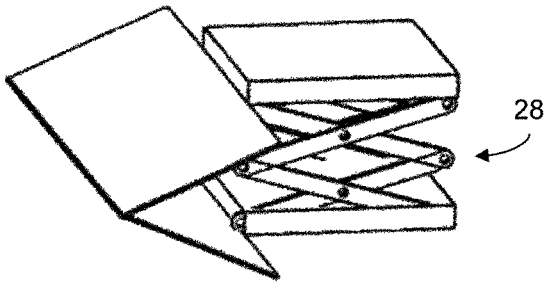
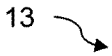
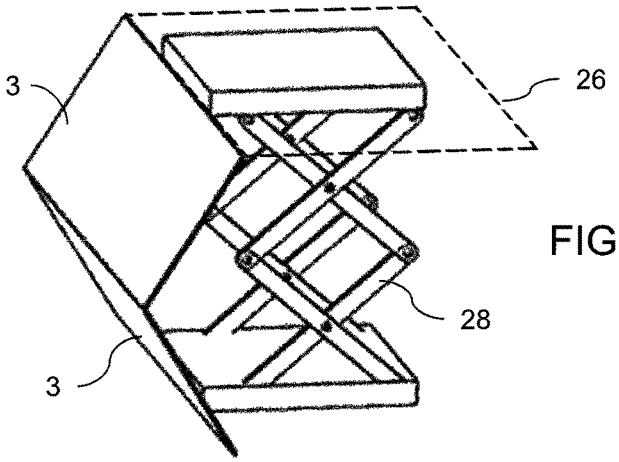
FIG. 9

RAPID DEPLOYMENT ANTI-BALLISTIC SHELTER

TECHNICAL FIELD AND BACKGROUND

The technical field of the present invention relates to ballistic or bullet resistant materials and structures.

BRIEF DESCRIPTION OF THE DRAWINGS

In the accompanying drawings:

FIG. 1 is a perspective view of an inflatable dome shaped embodiment of the rapid deployment anti-ballistic shelter;

FIG. 2 is a perspective view of an inflatable teepee shaped embodiment of the rapid deployment anti-ballistic shelter;

FIG. 3 is a perspective view of an inflatable pup tent shaped embodiment of the rapid deployment anti-ballistic shelter;

FIGS. 7 through 10 are perspective views of another mechanically deploying embodiment of the shelter with a series of hinged anti-ballistic panels configured to unfold into a wall when the shelter is deployed.

DESCRIPTION OF THE EMBODIMENTS

Figure 4:
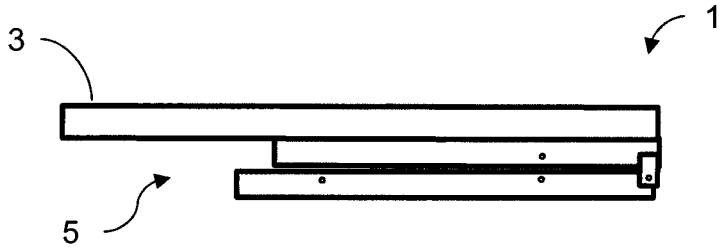
FIGS. 4 through 6 are side views of a mechanically deploying embodiment of the shelter, with a single anti-ballistic panel configure to be tilted up by an actuated linkage.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

The inventors have discovered that a previously unrealized need exists for a method of protecting gatherings of people against gunfire, particularly in situations such as large outdoor events in which a gunman is firing indiscriminately at a crowd. The inventors further realized that any type of protection that is pre-assembled and in place during such events is largely ineffective for the simple reason that the shooter would be aware of it and plan accordingly. The inventors deduced that an effective system should therefore be largely unobtrusive and inconspicuous, or even hidden until needed. The embodiments disclosed herein are accordingly intended to provide a protection system that will serve as an effective shield against gunfire for groups of people in a mass shooting scenario, but without unnecessarily interfering with or distracting from the event, or alerting a gunman ahead of time to the presence of such protection.

An exemplary rapid deployment anti-ballistic shelter in accordance with the present disclosure is indicated generally at reference numeral 1 in the drawing Figures. Shelter 1 is a rapidly deploying, or "pop-up" structure consisting of one or more anti-ballistic panels 3 attached to an elevating frame 5. The frame is rapidly configurable between a collapsed, or stowed condition in which the panels are laying or stacked flat on the ground or floor, and an elevated or deployed condition in which the panels are lifted or stood up by the frame in various vertical or tilted configurations.

Referring to FIGS. 1 through 3, the shelter 1 may be an inflatable structure with the frame 3 comprising an arrangement of inflatable beams 7 configured to form an elevated structure once fully inflated. The beams may be airtight, and made of a durable, fabric reinforced material that is flexible but substantially inelastic and capable of being inflated to a rigid condition. The panels 3 may be loosely connected to the beams and in some versions to each other, such as with cords or straps, so that when the beams are inflated and begin to lift up, the panels are pulled up with them.

For example, in the embodiment of FIG. 1, multiple interconnected beams 7 are arranged to form a dome shaped structure when inflated, with a single opening 9 on one side for ingress and egress. The structure may be inflated with a single high volume inflation device such as the depicted blower 8, or alternatively, one or more simultaneously activated pyrotechnic or compressed air gas generator devices connected to, or built into the structure. The inflation device or devices may use a one-way inflation valve to prevent the structure from deflating, and in any case the beams may be configured to hold and retain pressure once inflated for a period of minutes or even hours. For example, the structure may be capable of being inflated to a pressure in the range of 5 to 30 pounds per square inch (psi), and retaining at least 90 percent of the inflation pressure for one hour.

A plurality of triangular shaped anti-ballistic panels 3 are suspended from the inside of the frame 5 of FIG. 1. The triangular panels are configured to fit together, edge-to-edge, or overlapping, creating a substantially uninterrupted protective surface around the inside of the beam structure. Alternatively the panels 3 could be attached on the outside of the frame, forming an anti-ballistic surface that completely covers the inflated structure. In one embodiment the triangular panels are arranged generally in the form of a geodesic dome. The opening 9 may be covered with an optional moveable or hinged anti-ballistic panel or panels 3 than can be moved into place over opening 9 from inside the structure.

An inflatable structure such as that of FIG. 1 could be made essentially any size, and configured to hold a relatively large group of people if desired. In one embodiment the inflatable structure is between 10 and 20 feet across at the base, 7 to 12 feet high at the center, and capable of sheltering groups of between about 20 and 100 people.

The embodiments shown in FIGS. 2 and 3 are simpler inflatable configurations, generally more suited for protecting a smaller number of people, or even just one person. The embodiment shown in FIG. 2 is a teepee configuration with several interconnected inflatable beams 7 extending downward and outward, in the manner of tent poles, from a central apex 11. A triangular ballistic panel 3 is attached to the inside or outside of each adjacent pair of the inflatable beams 7, again forming an essentially contiguous protective surface. Ingress and egress is through a triangular shaped opening 9 between two adjacent inflatable beams 7 that is either not covered by a panel 3, or coverable from inside the structure as discussed above with a moveably mounted panel. The space underneath the structure when deployed is large enough for at least one adult in a sitting or prone position to be completely shielded from gunfire.

The embodiment of FIG. 3 is an elongated pup-tent configuration with an inflatable beam 7 at each end formed into a triangular shaped loop, and two tilted, rectangular anti-ballistic panels 3 extending between and supported by the beams. Ingress and egress is by stepping or crawling through an opening 9 at the center of the beam structure at each end. The end openings 9 may again be coverable from inside the structure as discussed above with a moveably mounted panel attached to the inside or outside of the beam structures. The deployed structure is long and wide enough at the base to protect at least one adult sitting or lying on the ground.

Figure 5:
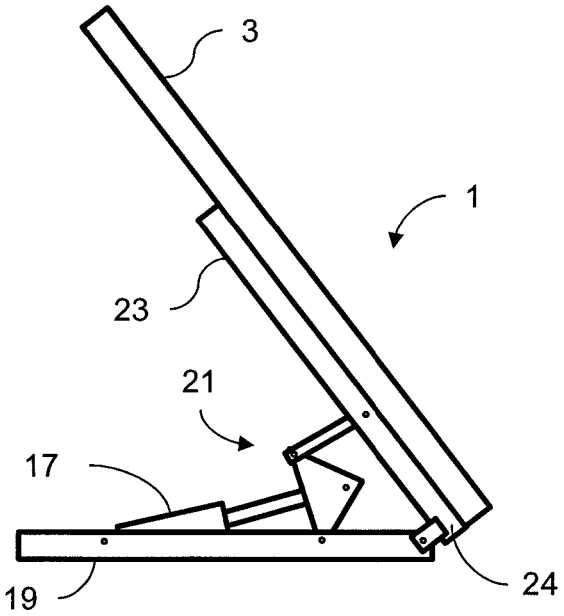
Figure 6:
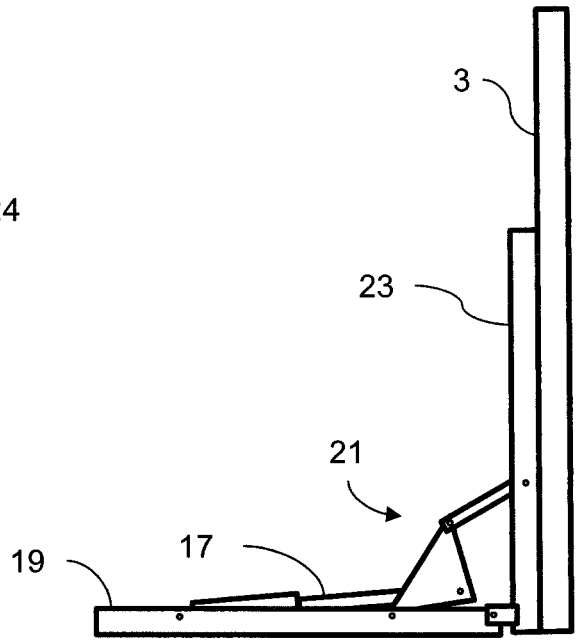

Referring now to FIGS. 4 through 9, the anti-ballistic shelter frame 5 may also be composed of rigid structural elements driven by a system of mechanical linkages and actuators. FIGS. 4 through 6 depict one such shelter embodiment in which a rigid frame 5 is moveable from a folded or collapsed condition shown in FIG. 4, to a fully extended or elevated condition shown in FIG. 6. A linkage 21 is driven by a hydraulic cylinder 17 disposed between the linkage and a base portion 19 of the frame. Extending the cylinder causes a moving frame member 23 connected to the linkage 21 to tilt upward about a hinged lower end 24. The ballistic panel 3 is attached to frame member 23, and thus extending the hydraulic cylinder 17 causes panel 3 to also tilt upward, eventually reaching the substantially vertical position depicted in FIG. 6. It should be appreciated that the extension function performed by the hydraulic cylinder could be accomplished with equal effect using a linear screw, or any of various other equivalent extending or actuating devices, or linkages.

The shelter embodiment of FIGS. 4 through 6 is intended to provide protection in one general direction by positioning the single anti-ballistic panel 3 perpendicularly between those seeking protection and the ballistic threat. When deployed, the anti-ballistic panel 3 may be tall enough to extend above a standing adult, and long enough to accommodate a line of people standing behind it. For example, in one embodiment the panel 3 is at least 8 feet tall, and 10 feet long.

FIGS. 7 through 9 depict another embodiment of shelter 1 based on a mechanical frame 5. The depicted shelter includes two hinged anti-ballistic panels 3 arranged adjacent an actuated scissor linkage 28. The linkage 28 may be constructed in the manner of a scissor jack, with a linear screw or hydraulic cylinder (not shown) configured to move the linkage and panels 25 from the collapsed, stowed condition of FIG. 7, to the fully extended and deployed condition shown in FIG. 9. The anti-ballistic panels are hinged together to unfold and form one large, substantially vertical surface when deployed. Although two anti-ballistic panels are shown, the present shelter embodiment could also consist of three or more hinged panels 3 arranged to unfold accordion style when lifted by the frame.

The panels 3 of the present embodiment thus provide generally single-direction, or single gunman protection, similar in that respect to the shelter embodiment of FIGS. 4 through 6. Alternatively, the shelter may further include a top anti-ballistic panel 26 (shown in dashed lines, and in FIG. 9 only) for additional protection against projectiles approaching from higher angles. As in the previous embodiment, the shelter may be tall enough and long enough when deployed to accommodate and protect a number of standing people.

The anti-ballistic panels 3 incorporate relatively stiff materials, and are capable of remaining substantially rigid and planar throughout deployment of the shelter. The panels may further incorporate ballistic resistant materials arranged in one more layers capable of slowing or stopping high velocity rifle bullets. In one embodiment the material layers are preferentially arranged to optimize ballistic resistance on one side of the panel versus the other side.

Figure 10:
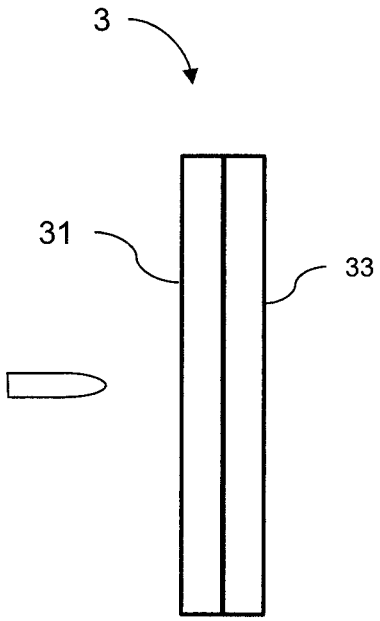

One example shown in FIG. 10 comprises a strike plate 31 made of a high hardness material, and a backing 33 formed from multiple layers of high strength fabric made from ballistic resistant fibers. In one embodiment the strike plate is ballistic grade ceramic, and the backing is cross-plied layers of unidirectional fiber sheets made of aramid or ultra-high molecular weight polyethylene, consolidated into a relatively thick, rigid layer. Directional constructions of this type are ubiquitous in the body and vehicle armor industry. One such example is disclosed in U.S. Pat. No. 6,408,733, assigned to the assignee of the present disclosure, and hereby incorporated by reference in its entirety.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed is:

1. A ballistic resistant shelter configured for emergency deployment in an open space, comprising:

a structural frame configured to rapidly convert from a stowed condition disposed substantially flat on the ground, to a deployed condition in which the frame is elevated substantially above ground level, wherein the structural frame is a metal construction with a base, a moving portion, and a linkage disposed between the base and moving portion;

one or more rigid anti-ballistic panels attached to the frame so as to be tilted or lifted above ground level when the frame is deployed, wherein the one or more rigid anti-ballistic panels collectively present enough surface area with the frame in the deployed condition to shield at least one person from a single source of gunfire; and an actuator configured to cause the frame to rapidly convert from the stowed condition to the deployed condition.

2. The ballistic resistant shelter of claim 1, wherein the structural frame comprises a plurality of inflatable beams, and the actuator comprises a rapid inflation device.

3. The ballistic resistant shelter of claim 2, wherein the rapid inflation device comprises one or more pyrotechnic or compressed air gas generator devices.

4. The ballistic resistant shelter of claim 2, wherein the one or more anti-ballistic panels are attached to the inflatable beams and positioned immediately adjacent or overlapping one another to form a substantially uninterrupted protective surface when the beams are inflated.

5. The ballistic resistant shelter of claim 1, wherein the one or more anti-ballistic panels are a layered construction comprising a strike plate, and a backing made from high strength ballistic fibers.

6. The ballistic resistant shelter of claim 1, wherein the actuator is a hydraulic or linear screw device connected between the base and the linkage, that when extended causes the moving portion of the frame to be raised.

7. The ballistic resistant shelter of claim 1, wherein the moving portion of the frame is configured to translate vertically upward when the actuator is extended, and the one or more anti-ballistic panels comprise at least two hinged panels configured to unfold when the moving portion translates upward.

8. The ballistic resistant shelter of claim 6, wherein the one or more anti-ballistic panels comprise a single panel attached to the moving portion of the frame, and where extending the actuator causes the single panel to tilt upward.

9. An inflatable ballistic resistant shelter configured for emergency deployment in an open space, comprising:

a structural frame comprising a series of inflatable beams configured to be rapidly deployable from a deflated condition disposed substantially flat on the ground, to an inflated condition in which the frame is elevated substantially above ground level, wherein the series of inflatable beams are interconnecting segments that form a dome shaped structure with openings between the segments; and one or more triangular anti-ballistic panels attached to the frame so as to be tilted or lifted above ground level when the frame is deployed, wherein the one or more triangular anti-ballistic panels together present enough surface area when the frame is in the inflated condition to shield at least one person from a single source of gunfire, and wherein the openings are covered by the triangular anti-ballistic panels that collectively form a substantially uninterrupted surface on the outside or inside of the frame.

10. The inflatable ballistic resistant shelter of claim 9, wherein the frame is capable of retaining at least 90 percent of an inflation pressure in the range of 5 to 30 pounds per square inch for at least one hour.

11. The inflatable ballistic resistant shelter of claim 9, wherein the shelter in the inflated condition is between 10 and 20 feet across at the base, and 7 to 12 feet high at the center.

12. The inflatable ballistic resistant shelter of claim 9, wherein the shelter in the inflated condition is large enough to hold groups of between 20 and 100 people.

13. The inflatable ballistic resistant shelter of claim 9, wherein the series of inflatable beams are straight segments extending outward and downward from a central apex in the manner of a teepee.

14. The inflatable ballistic resistant shelter of claim 9, wherein the series of inflatable beams are two separate segments, each in the shape of a triangular loop with a center opening, and wherein the one or more anti-ballistic panels are two rectangular panels leaned toward one another in the manner of a pup tent, connected at opposite ends to the inflatable beams.

15. The inflatable ballistic resistant shelter of claim 9, further comprising a rapid inflation device connected to the frame through a one-way valve.

16. The inflatable ballistic resistant shelter of claim 15, wherein the rapid inflation device comprises a high volume blower, or one or more pyrotechnic or compressed air gas generator devices.

* * * * *